US009448044B1

(12) United States Patent
Swailes

(10) Patent No.: US 9,448,044 B1
(45) Date of Patent: Sep. 20, 2016

(54) MOVING TARGET DEVICE

(71) Applicant: Robert Swailes, Wright City, MO (US)

(72) Inventor: Robert Swailes, Wright City, MO (US)

( * ) Notice: Subject to any disclaimer, the term of this patent is extended or adjusted under 35 U.S.C. 154(b) by 0 days.

(21) Appl. No.: 14/833,063

(22) Filed: Aug. 22, 2015

Related U.S. Application Data

(60) Provisional application No. 62/061,506, filed on Oct. 8, 2014.

(51) Int. Cl.
*F41J 7/00* (2006.01)
*F41J 9/02* (2006.01)

(52) U.S. Cl.
CPC .... *F41J 9/02* (2013.01); *F41J 7/00* (2013.01)

(58) Field of Classification Search
CPC ..... F41J 1/10; F41J 7/04; F41J 7/06; F41J 7/00; F41J 7/02; F41J 9/00
USPC ..... 273/359, 366–370, 406, 407
See application file for complete search history.

(56) References Cited

U.S. PATENT DOCUMENTS 683,172 A 9/1901 Foster
1,116,283 A 11/1914 Howard
2,134,777 A 11/1938 Clancy
2,811,680 A 10/1957 Josef
3,297,326 A 1/1967 Corwin
3,476,223 A 11/1969 Hubbard
3,703,845 A * 11/1972 Griew ..... F41G 3/26 273/405
3,744,796 A * 7/1973 Renault ..... F41J 9/02 273/369
4,004,262 A 1/1977 Grove
4,232,867 A 11/1980 Tate
5,240,258 A 8/1993 Bateman
5,951,016 A 9/1999 Bateman
8,534,672 B2 9/2013 Brune
2008/0174071 A1 7/2008 Potterfield et al.
2008/0265511 A1 10/2008 Shum
2010/0225062 A1* 9/2010 Shum ..... F41J 7/06 273/359
2011/0248447 A1* 10/2011 Yang ..... F41J 1/10 273/355
2012/0043722 A1 2/2012 Mironichev et al.
2012/0091661 A1* 4/2012 Wright ..... F41J 7/06 273/406
2015/0233685 A1* 8/2015 Dennison ..... F41J 9/02 273/369

* cited by examiner

*Primary Examiner* — Mark Graham
(74) *Attorney, Agent, or Firm* — Grace J. Fishel

(57) ABSTRACT

A moving target device is disclosed having a target mounting frame for holding a target therein, a pivot assembly connected to the target mounting frame, an upper support arm and a lower support arm connected to the pivot assembly, a magnet support assembly connected to the pivot assembly, an electric magnet connected to the magnet support assembly, a motor connected to the lower support arm, a disk connected to the motor and capable of being rotated the motor, a spring connected to the magnet support assembly and the lower support arm, and a stop plate for controlling movement of the pivot assembly.

20 Claims, 4 Drawing Sheets

MOVING TARGET DEVICE

CROSS REFERENCE TO RELATED APPLICATIONS

This application claims priority to the provisional patent application having Ser. No. 62/061,506, filed on Oct. 8, 2014,

BACKGROUND

This disclosure relates generally to a moving target device, and more particularly to a moving target device for practicing shooting at a target and for training.

Moving targets have been used to train individuals in using firearms. Examples of moving targets include devices that have a target that pops up, swings, or moves horizontally. Some prior moving target devices are heavy, large, difficult to transport, complex, and slow reacting. Since it may be important to law enforcement personnel or soldiers to regularly participate in training or certification, having moving target devices that are cumbersome may inhibit training. It is also important to be able to simulate real life shooting situations. If the moving target device is slow then a real life shooting situation may not be possible. Also, if the moving target device is slow then a shooter may not be able to improve on reaction rate or timing.

The present disclosure is designed to obviate and overcome many of the disadvantages and shortcomings experienced with prior moving target devices. Moreover, the present disclosure is related to a moving target device that quickly presents a target for shooting at and quickly removes the target from a shooting position or orientation. The moving target device of the present disclosure is also simple to set up and to learn how to operate and use.

SUMMARY

In one form of the present disclosure, a moving target device is disclosed which comprises a target mounting frame for holding a target therein, a pivot assembly connected to the target mounting frame, an upper support arm and a lower support arm connected to the pivot assembly, a magnet support assembly connected to the pivot assembly, an electric magnet connected to the magnet support assembly, a motor connected to the lower support arm, a disk connected to the motor and capable of being rotated by the motor, a spring connected to the magnet support assembly and the lower support arm; and a stop plate for controlling movement of the pivot assembly.

In another form of the present disclosure, a moving target device comprises a target mounting frame for holding a target therein, a pivot assembly having an upper pivot pin and a lower pivot pin, the pivot assembly connected to the target mounting frame for moving the target mounting frame between a non-shooting position and a shooting position, an upper support arm having an aperture for receiving the upper pivot pin and a lower support arm having an aperture for receiving the lower pivot pin, a magnet support assembly connected to the pivot assembly, an electric magnet connected to the magnet support assembly, a motor connected to the lower support arm, a disk connected to the motor and capable of being rotated by the motor, a spring connected to the magnet support assembly and the lower support arm, and a stop plate for controlling movement of the pivot assembly.

In still another form of the present disclosure, a moving target device comprises a target mounting frame for holding a target therein, a pivot assembly having an upper pivot pin and a lower pivot pin, the pivot assembly connected to the target mounting frame for moving the target mounting frame between a non-shooting position and a shooting position, an upper support arm having an aperture for receiving the upper pivot pin and a lower support arm having an aperture for receiving the lower pivot pin and a spring retaining clip, a magnet support assembly connected to the pivot assembly and having a spring retaining clip, an electric magnet connected to the magnet support assembly, a motor connected to the lower support arm, a disk connected to the motor and capable of being rotated by the motor, a spring having a first end and a second with the first end being connected to the spring retaining clip of the magnet support assembly and the second end being connected to the spring retaining clip of the lower support arm, and a stop plate for controlling movement of the pivot assembly.

In light of the foregoing comments, it will be recognized that the moving target device of the present disclosure is of simple construction and design and which can be easily employed with highly reliable results.

The present disclosure provides a moving target device that may be used to enhance reaction time of a shooter and to develop and improve hand to eye coordination.

The present disclosure provides a moving target device that may be mounted or positioned on a pole for use.

The present disclosure provides a moving target device that can be operated manually or remotely to present a target at different time intervals.

The present disclosure is directed to a moving target device that quickly displays a target and quickly resets or repositions the target.

The present disclosure also provides a moving target device that can have a target easily removed for placement of a new target.

The present disclosure further provides a moving target device that is compact and may easily be carried, stored, transported, inventoried, and operated.

The present disclosure provides a moving target device that can be constructed using readily available materials.

The present disclosure also provides a moving target device that may be used to practice shooting at a target with the target being controlled by an individual other than a shooter.

These and other advantages of the present disclosure will become apparent after considering the following detailed specification in conjunction with the accompanying drawings, wherein:

DETAILED DESCRIPTION OF THE PREFERRED EMBODIMENTS

Figure 1:
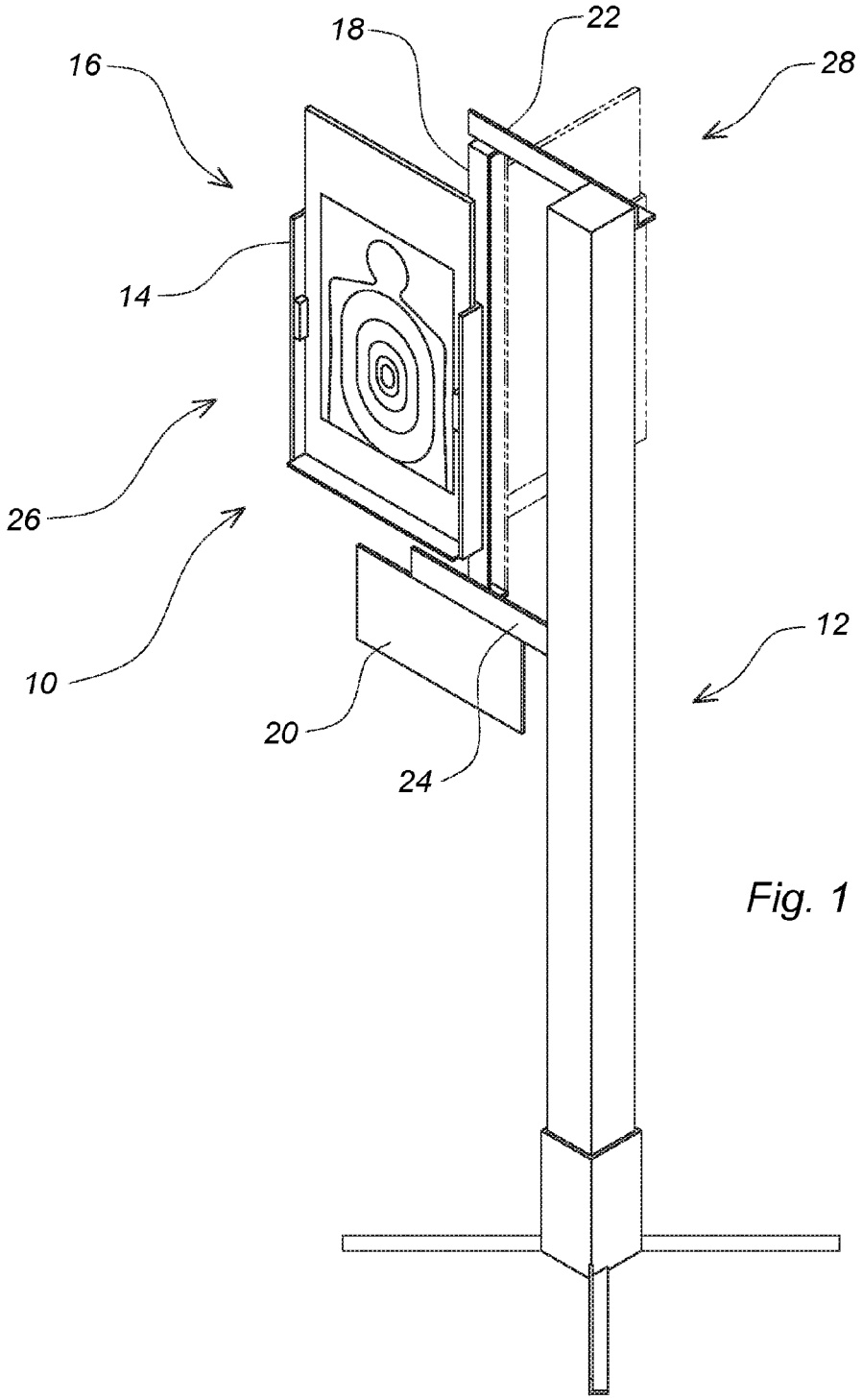
FIG. 1 is a perspective view of a moving target device constructed according to the present disclosure with a target shown in a shooting position and a target shown in phantom in a non-shooting position.

Referring now to the drawings, wherein like numbers refer to like items, number 10 identifies a preferred embodiment of a moving target device constructed according to the present disclosure. With reference now to FIG. 1, the moving target device 10 is shown mounted on a post assembly 12. The moving target device 10 comprises a target mounting frame 14 having a target 16 positioned therein, a pivot assembly 18, a guard 20, an upper support arm 22, and a stop plate 24. The arm 22 is used to attach or secure the moving target device 10 to the post assembly 12. The moving target device 10 is shown in a shooting position 26 in FIG. 1 and also shown in phantom in a non-shooting position 28. In particular, a shooter will aim at the target 16 to shoot at the target 16 when the moving target device 10 is in the shooting position 26 as shown in FIG. 1. Also, when the target 16 is in the non-shooting position 28 a shooter will not be able to see or shoot at the target 16. Although the post assembly 12 is shown as being movable, it is possible and contemplated that the post assembly 12 may be secured in place such as to an existing metal post or pole. Although the guard 20 and the stop plate 24 are shown as being separate components, it is contemplated that the guard 20 and the stop plate 24 may be a unitary construction.

Figure 2:
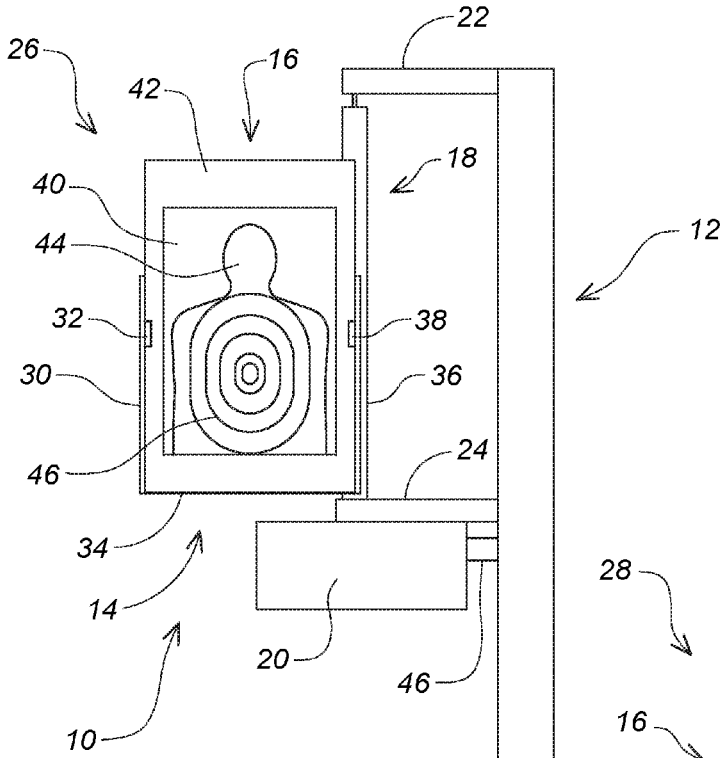
FIG. 2 is a partial front view of the moving target device constructed according to the present disclosure with a target shown in a shooting position.

FIG. 2 shows a partial front perspective view of the moving target device 10 in the shooting position 26. The moving target 10 has the target mounting frame 14 which comprises a left side arm 30 having a retaining tab 32, a bottom arm 34, and a right side arm 36 having a retaining tab 38. The target mounting frame 14 is used to hold the target 16 therein. The target 16 may consist of a paper target 40 attached to a board 42. By use of the target mounting frame 14, the target 16 may be easily inserted into the target mounting frame 14 and removed when a shooting event has been completed. The paper target 40 can have any type target printed thereon such as an outline of a human 44 having concentric ovals 46 representing different scoring options. As can be appreciated, the target 16 may be of a unitary construction in which the paper target 40 and the board 42 are formed as a single unit.

The moving target device 10 is also shown having the upper support arm 22 and a lower support arm 46 connected to the post assembly 12. The moving target device 10 may be easily removed from the post assembly 12 by removing the arms 22 and 46 from the post assembly 12. The pivot assembly 18 is connected to the upper arm 22 and the lower arm 46. The pivot assembly 18 is capable of moving the target 16 between the shooting position 26 and the non-shooting position 28, as will be explained in detail herein. The guard 20 is used to shield or protect various other components (not shown) of the moving target device 10 from being struck by a bullet or other projectile.

Figure 3:
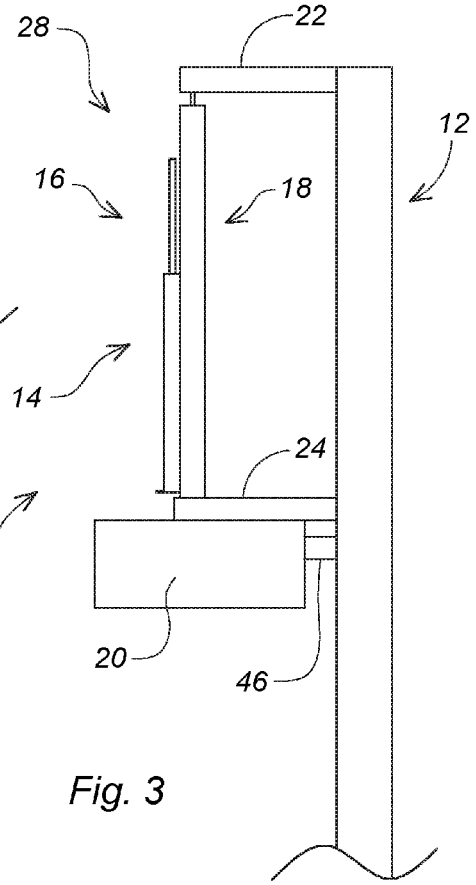
FIG. 3 is a partial front view of the moving target device constructed according to the present disclosure with a target shown in a non-shooting position.

With reference now to FIG. 3, a partial front perspective view of the moving target device 10 in the non-shooting position 28 is depicted. The target 16 has been moved or pivoted to the non-shooting position 28 by use of the pivot assembly 18 and other components which will be described further herein. In the non-shooting position 28, the target 16 is not visible to a shooter. Once in the non-shooting position 28, the shooter will cease shooting at the device 10. The moving target device 10 is shown having the target mounting frame 14 having the target 16 positioned therein, the pivot assembly 18, the guard 20, the upper arm 22, and the lower arm 46. As has been previously described, the arms 22 and 46 are attached or connected to the post assembly 12 for easy removal of the device 10.

Figure 4:
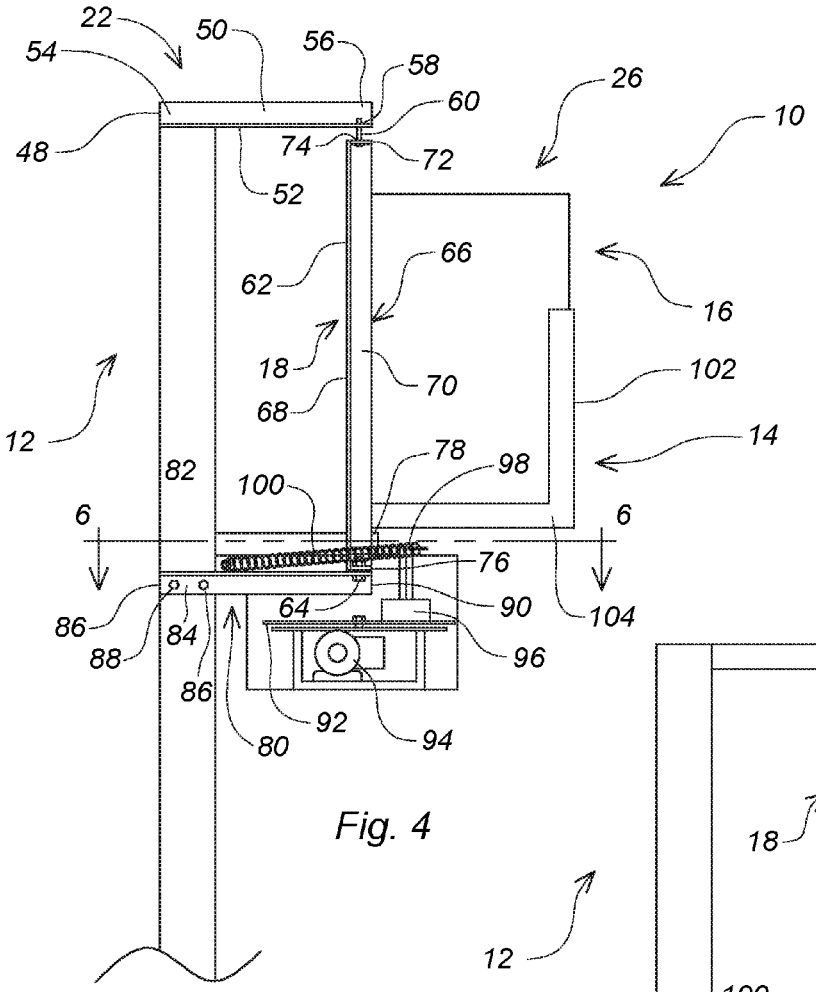
FIG. 4 is a partial rear view of the moving target device constructed according to the present disclosure with a target shown in a shooting position.

FIG. 4 illustrates a perspective rear view of the moving target device 10 with the target 16 being in the shooting position 26. The upper arm 22 may consist of an L-shaped arm or angle iron 48 having an upper leg 50 and a lower leg 52. A first end 54 of the arm 22 may be attached or connected to the post assembly 12 by use of any suitable connector such as screws or bolts, neither of which are shown. It is also possible that other connecting devices may be used to attach or secure the arm 22 to the post assembly 12. By way of example only, clamps, adhesives, hook and loop fasteners, cables, and straps may be used as suitable connecting devices. A second end 56 of the arm 22 may have an aperture 58 through which a pivot pin 60 is inserted. The pivot assembly 18 includes the pivot pin 60, a central spindle or pivot arm 62, and a lower pivot pin 64. The pivot arm 62 may consist of an L-shaped arm or angle iron 66 having a first leg 68 and a second leg 70. The arm 62 has a top end or bracket 72 having an aperture 74 formed therein for receiving and capturing the pivot pin 60. The arm 62 also has a bottom end or bracket 76 having an aperture 78 formed therein for receiving and capturing the lower pivot pin 64. Although not shown, the second leg 70 of the pivot arm 62 may have a few apertures to facilitate connecting or attaching the target mounting frame 14 to the arm 62.

The lower support arm 46 may also be formed of an L-shaped arm or angle iron 80 having an upper leg 82 and a lower leg 84. A first end 86 of the arm 46 may be attached or connected to the post assembly 12 by use of any suitable connectors 88 inserted through apertures (not shown) formed in the lower leg 84. Examples of suitable connectors 88 are screws, nails, or bolts. A second end 90 of the arm 46 may have an aperture (not shown) formed therein for receiving the lower pivot pin 64. The pivot pin 64 may be a threaded pin and various components, such as washers and nuts, may be used to hold the pivot pin 64 in place while still allowing the pivot pin 64 to rotate.

The pivot assembly 18 may be moved between the shooting position 26 and the non-shooting position 28 by use of a rotating metal disk 92 connected to a motor 94, an electric magnet 96 connected to a magnet support assembly 98 which is connected to the arm 66, and a return spring 100 connected to the magnet support assembly 98 and the upper leg 82. The motor 94 is used to continuously rotate the disk 92. The electric magnet 96, when energized, will be attracted to the rotating metal disk 92 and will move the pivot assembly 18 from the non-shooting position 28 to the shooting position 26. The electric magnet 96 is not strong enough to stop rotation of the disk 92. However, it is possible that the speed of the disk 92 may decrease when the electric magnet 96 is energized. When the electric magnet 96 is de-energized the spring 100 will return the pivot assembly 18 to the non-shooting position 28. The pivot assembly 18 is only capable of rotating in a 90° arc or angle due to the stop plate 24 preventing further rotation of the pivot assembly 18. In particular, the stop plate 24 will contact the second leg 70 of the arm 66 to stop any rotation of the pivot assembly 18 past the stop plate 24. As indicated above, if the guard 20 and the stop plate 24 are of unitary construction, then the guard 20 may also act as an obstruction to stop movement of the pivot assembly 18 past a certain point. The motor 94 may be an electric motor such as a 12 volt direct current motor. Although not shown, it is to be understood that the motor 94 is connected to a source of energy via any suitable conduit or wires. It is also possible that the motor 94 may be connected to a battery or a solar cell. The electric magnet 96 may be connected to a switch for selectively operating the magnet 96, although such switch and connection are not shown. It is further possible that the switch may be a remote control switch, a foot switch or pedal, or even a computer operated switch that can be programmed to operate the device 10 in a random or predetermined manner or pattern. For example, the computer may be a smart phone having an application that can control a remote switch associated with the device 10 by Bluetooth® or other wireless technology or connectivity.

The target mounting frame 14 also has a right side rear arm 102, a bottom rear arm 104, and a left side rear arm (not shown) that is used to capture the target 16. The left side arm 30, the retaining tab 32, the bottom arm 34, the right side arm 36, the retaining tab 38, the right side rear arm 102, the bottom rear arm 104, and the left side rear arm formed a channel in which the target 16 is placed and held. In this manner, the target mounting frame 14 may be used to easily and quickly removed a used target to insert a new target.

Figure 5:
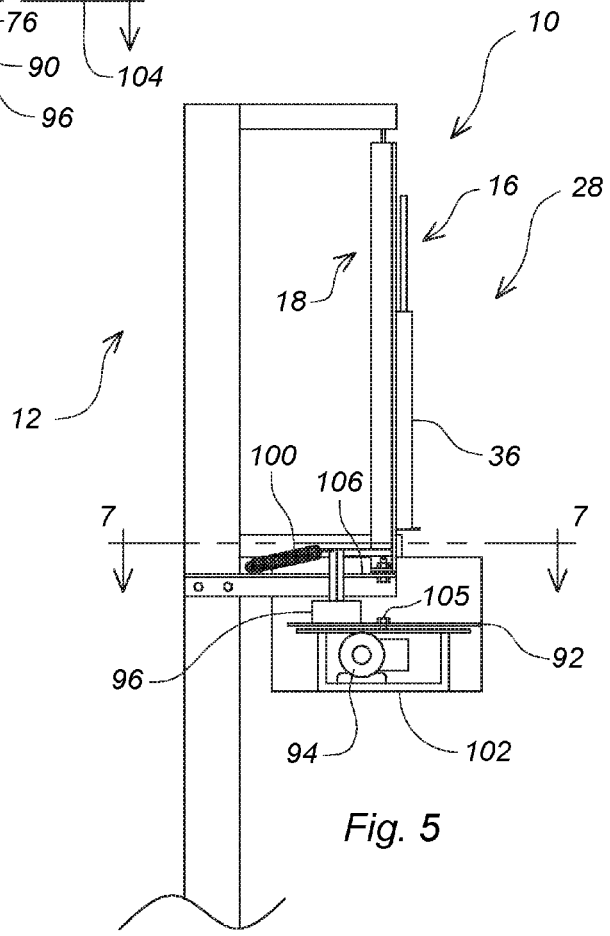
FIG. 5 is a partial rear view of the moving target device constructed according to the present disclosure with a target shown in a non-shooting position.

FIG. 5 shows the moving target device 10 connected to the post assembly 12 with the target 16 being in the non-shooting position 28. In this particular view, the electric magnet 96 has not been energized and is thus not attracted to the rotating metal disk 92. There is also no tension on the spring 100 and no rotation or movement of the pivot assembly 18. The motor 94 may be positioned in a motor housing assembly 102 that may be connected to the guard 20 and the lower support arm 46. The motor 94 has a spindle 105 that passes through the assembly 102 and is connected to the disk 92 to spin or rotate the disk 92. The electric magnet 96 is positioned above the disk 92. The right side arm 36 is also shown holding the target 16 in position. The moving target device 10 is ready to be repositioned from the non-shooting position 28 to the shooting position 26 upon energizing the electric magnet 96.

Figure 6:
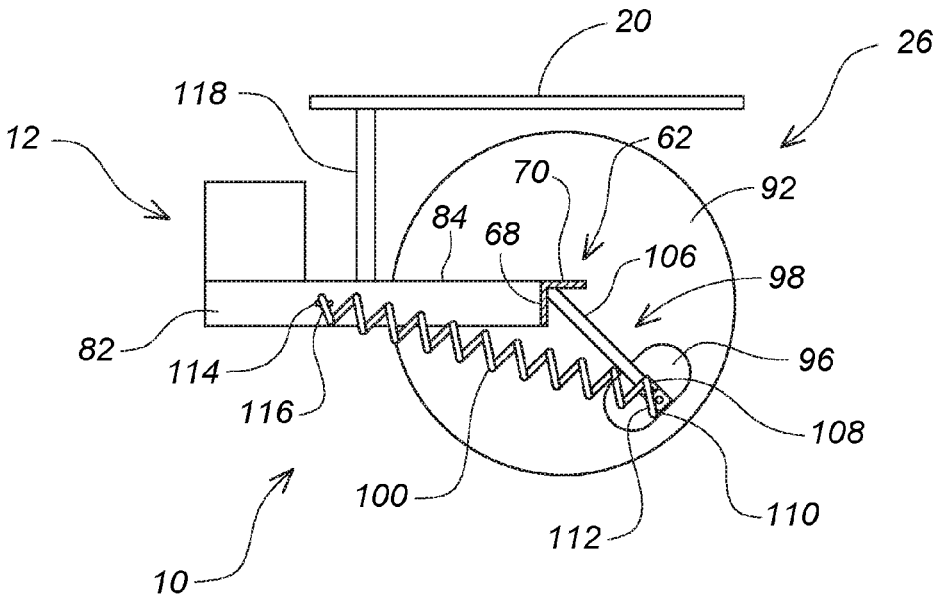
FIG. 6 is a partial cross-sectional top view of a pivoting assembly of the moving target device shown in a shooting position taken below the plane of line 6-6 of FIG. 4.

With reference now to FIG. 6, the moving target device 10 is shown in the shooting position 26. The magnet support assembly 98 has a horizontal arm 106 that is connected to a vertical arm 108 and the first leg 68 and the second leg 70 of the pivot arm 62. The electric magnet 96 is connected to the vertical arm 108, which is best shown in FIG. 5. The arms 106 and 108 form the magnet support assembly 98. The horizontal arm 106 has a spring retaining clip 110 that is used to retain a first end 112 of the spring 100. The upper leg 82 of the lower support arm 46 also has a spring retaining clip 114 for retaining a second end 116 of the spring 100. The spring 100 is held in place by use of the clips 110 and 114. As can be appreciated, when the spring 100 is extended or under tension, as shown in FIG. 6, the spring 100 will be able to quickly return the magnet support assembly 98 to the non-shooting position 28 when the electric magnet 96 is de-energized. As has been previously described, the rotating metal disc 92 is capable of continuously rotating even when the electric magnet 96 is energized. The device 10 also has a support arm 118 that connects the guard 20 to the lower leg 84. The guard 20 is used to protect the disc 92, motor 94 (FIG. 4), the electric magnet 96, the magnet support assembly 98, and the spring 100 from any bullet that may hit the guard 20.

Figure 7:
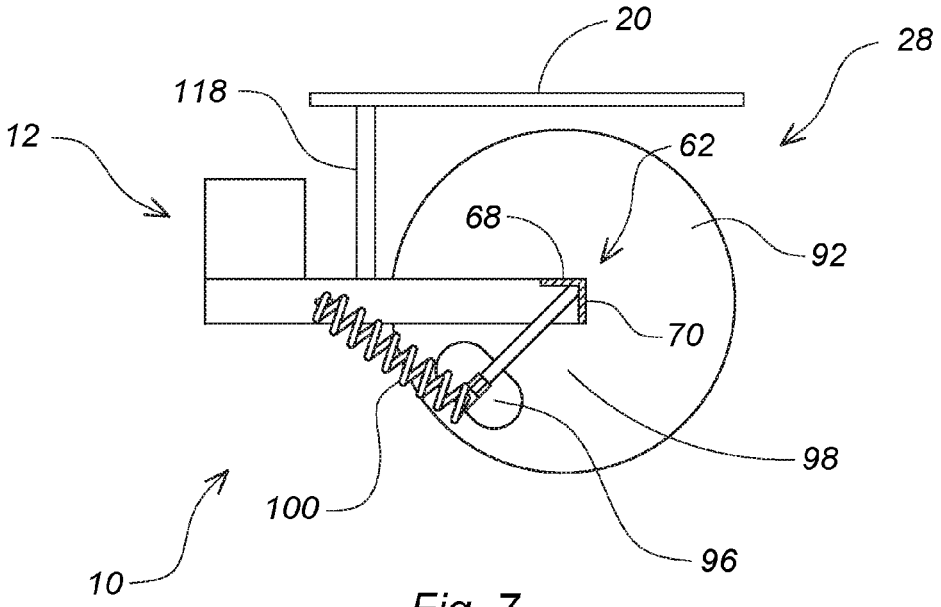
FIG. 7 is a partial cross-sectional top view of a pivoting assembly of the moving target device shown in a non-shooting position taken below the plane of line 7-7 of FIG. 5.

FIG. 7 illustrates the moving target device 10 being in the non-shooting position 28. The spring 100 has moved, pulled, or returned the magnet support assembly 98 to the non-shooting position 28 due to tension in the spring 100 being released by de-energizing the electric magnet 96. The pivot arm 62 has moved 90° as compared to the position of the pivot arm 62 shown in FIG. 6. This movement is due to the spring 100 pulling the pivot arm 62 back into the non-shooting position 28. The electric magnet 96 has been de-energized and is not attracted to the rotating metal disk 92. The disk 92 is free to rotate when the electric magnet 96 is de-energized. Once the electric magnet 96 is energized, the magnet 96 will be attracted to the disk 92 to travel with the disk 92 until the stop plate 24 is encountered.

The moving target device 10 may operate in the following manner. The moving target device 10 is connected to the post assembly 12 in a safe place for shooting. The device 10 is connected to a power source to be able to operate the motor 94 and the electric magnet 96. As has been discussed, the power source may be a battery if the device 10 is positioned in a remote location far from utility lines. Once connected, the target 16 is positioned within the target mounting frame 14. Initially, the target 16 is in the non-shooting position 28. The motor 94 begins spinning the disk 92 and a switch may be operated to energize the electric magnet 96. Once the electric magnet 96 is energized, the magnet 96 will be magnetically attracted to the rotating disk 92. This attraction will move the magnet support assembly 98, the pivot assembly 18, the target mounting frame 14, and the target 16 into the shooting position 26. Movement of these components 98, 18, 14, and 16, will also stretch out the spring 100. These components 98, 18, 14, and 16 will continue moving until the second leg 70 of the pivot arm 62 impacts or contacts the stop plate 24, the guard 20, or both. The electric magnet 96 will still be attracted to the rotating disk 92 to keep the target 16 in place. Otherwise, the spring 100 would pull the target 16 back to the non-shooting position 28. At this point, the device 10 presents the target 16 in the shooting position 26 and a shooter may attempt to hit the target 16. At some point the electric magnet 96 is de-energized and once de-energized the electric magnet 96 is no longer attracted to the spinning disk 92. The spring 100 will move the pivot arm 18 back to the non-shooting position 28. Movement of the pivot arm 18 also causes rotation or movement of the target mounting frame 14 and the target 16 to the non-shooting position 28. The magnet arm assembly 98 is also repositioned to the non-shooting position 28. The moving target device 10 is now ready for presentation of the target 16 into the shooting position 26 upon energizing the electric magnet 96. It is also possible that the target 16 may now be replaced with a new target 16. For example, a first shooter may shoot at one target 16 and a second shooter may shoot at a second target 16. Once the targets 16 are removed from the target mounting frame 14, the targets 16 may be scored.

As can be appreciated, various different shapes and sizes of targets 16 may be placed into the target mounting frame 14. It is also possible that numerous moving target devices 10 may be set up for training purposes at a shooting range. For example, a first moving target device 10 may present the target 16 in the shooting position 26 for a first time interval and a second moving target device 10 may present the target 16 in the shooting position 26 for a second longer time interval. Further, by using springs 100 having different tensions, it is possible that a partial shooting position 26 may be presented to a shooter. In this particular arrangement, the electric magnet 96 may only be able to move the pivot assembly 18 less than 90° and only a portion of the target 16 is visible to a shooter. The device 10 may be controlled by a person shooting at the target 16 or by another person, such as an instructor. If an instructor is controlling operation of the device 10, then the instructor can control when and for how long the target 16 will be presented or visible in the shooting position 26. As has been indicated above, it is also possible that the device 10 may be under computer control and the target 16 may be presented in the shooting position 26 at various timed intervals such as random time intervals.

The moving target device 10 may be constructed of any suitable material such as thick steel or steel plate. By way of example only, the steel may have a thickness of 13 mm. Some examples of the sizes of the various components of the device 10 are that the disc 92 may have a diameter of 250 mm, the upper support arm 22 and the lower support arm 46 may have a length of 250 mm, the pivot arm 62 may have a length of 720 mm, and the guard 20 may be 400 mm by 200 mm. However, these are examples only and other dimensions are possible and contemplated.

From all that has been said, it will be clear that there has thus been shown and described herein a moving target device which fulfills the various objects and advantages sought therefor. It will be apparent to those skilled in the art, however, that many changes, modifications, variations, and other uses and applications of the subject moving target device are possible and contemplated. All changes, modifications, variations, and other uses and applications which do not depart from the spirit and scope of the disclosure are deemed to be covered by the disclosure, which is limited only by the claims which follow.

What is claimed is:

1. A moving target device comprising:
- a target mounting frame for holding a target therein;
- a pivot assembly connected to the target mounting frame;
- an upper support arm and a lower support arm connected to the pivot assembly;
- a magnet support assembly connected to the pivot assembly;
- an electric magnet connected to the magnet support assembly;
- a motor connected to the lower support arm;
- a disk connected to the motor and capable of being rotated by the motor;
- a spring connected to the magnet support assembly and the lower support arm; and
- a stop plate for controlling movement of the pivot assembly.

2. The moving target device of claim 1 further comprising a switch for energizing the electric magnet.

3. The moving target device of claim 1 further comprising a guard for protecting the motor, the electric magnet, and the disk from being hitting by a projectile.

4. The moving target device of claim 1 wherein the upper support arm and the lower support arm may be connected to a post assembly.

5. The moving target device of claim 1 wherein the motor is a direct current motor.

6. The moving target device of claim 1 wherein the target mounting frame comprises a left side arm having a retaining tab, a bottom arm, and a right side arm having a retaining tab.

7. A moving target device comprising:
- a target mounting frame for holding a target therein;
- a pivot assembly having an upper pivot pin and a lower pivot pin, the pivot assembly connected to the target mounting frame for moving the target mounting frame between a non-shooting position and a shooting position;
- an upper support arm having an aperture for receiving the upper pivot pin and a lower support arm having an aperture for receiving the lower pivot pin;
- a magnet support assembly connected to the pivot assembly;
- an electric magnet connected to the magnet support assembly;
- a motor connected to the lower support arm;
- a disk connected to the motor and capable of being rotated by the motor;
- a spring connected to the magnet support assembly and the lower support arm; and
- a stop plate for controlling movement of the pivot assembly.

8. The moving target device of claim 7 further comprising a switch for energizing the electric magnet.

9. The moving target device of claim 7 wherein the upper support arm further comprises an end having an aperture formed therein for receiving a connector device there through for attaching the upper support arm to a post assembly.

10. The moving target device of claim 7 wherein the lower support arm further comprises an end having an aperture formed therein for receiving a connector device there through for attaching the lower support arm to a post assembly.

11. The moving target device of claim 7 wherein the motor is a direct current motor.

12. The moving target device of claim 7 wherein the target mounting frame comprises a left side arm having a retaining tab, a bottom arm, and a right side arm having a retaining tab.

13. The moving target device of claim 12 wherein the target mounting frame further comprises a right side rear arm, a bottom rear arm, and a left side rear arm.

14. A moving target device comprising:
- a target mounting frame for holding a target therein;
- a pivot assembly having an upper pivot pin and a lower pivot pin, the pivot assembly connected to the target mounting frame for moving the target mounting frame between a non-shooting position and a shooting position;
- an upper support arm having an aperture for receiving the upper pivot pin and a lower support arm having an aperture for receiving the lower pivot pin and a spring retaining clip;
- a magnet support assembly connected to the pivot assembly and having a spring retaining clip;
- an electric magnet connected to the magnet support assembly;
- a motor connected to the lower support arm;
- a disk connected to the motor and capable of being rotated by the motor;
- a spring having a first end and a second with the first end being connected to the spring retaining clip of the magnet support assembly and the second end being connected to the spring retaining clip of the lower support arm; and
- a stop plate for controlling movement of the pivot assembly.

15. The moving target device of claim 14 further comprising a switch for energizing the electric magnet for the electric magnet to be magnetically attracted to the rotating disk to move the pivot assembly from the non-shooting position to the shooting position.

16. The moving target device of claim 14 further comprising a guard for protecting the motor, the electric magnet, and the disk from being hitting by a projectile.

17. The moving target device of claim 14 wherein the upper support arm further comprises an end having an aperture formed therein for receiving a connector device there through for attaching the upper support arm to a post assembly.

18. The moving target device of claim 14 wherein the lower support arm further comprises an end having an aperture formed therein for receiving a connector device there through for attaching the lower support arm to a post assembly.

19. The moving target device of claim 14 wherein the target mounting frame comprises a left side arm having a retaining tab, a bottom arm, and a right side arm having a retaining tab.

20. The moving target device of claim 19 wherein the target mounting frame further comprises a right side rear arm, a bottom rear arm, and a left side rear arm.

* * * * *